US010632515B2

(12) United States Patent
Hillegas

(10) Patent No.: US 10,632,515 B2
(45) Date of Patent: Apr. 28, 2020

(54) DRIVE CLEAT TOOL

(71) Applicant: Tim Hillegas, Kent, WA (US)

(72) Inventor: Tim Hillegas, Kent, WA (US)

( * ) Notice: Subject to any disclaimer, the term of this patent is extended or adjusted under 35 U.S.C. 154(b) by 23 days.

(21) Appl. No.: 15/949,859

(22) Filed: Apr. 10, 2018

(65) Prior Publication Data

US 2018/0304338 A1 Oct. 25, 2018

Related U.S. Application Data

(60) Provisional application No. 62/487,585, filed on Apr. 20, 2017.

(51) Int. Cl.
*B21D 39/02* (2006.01)
*B21D 41/00* (2006.01)

(52) U.S. Cl.
CPC ..... *B21D 39/025* (2013.01); *B21D 41/00* (2013.01)

(58) Field of Classification Search
CPC ..... B25B 27/14; B25B 27/146; B25B 33/00; B21D 39/025; B21D 41/00
See application file for complete search history.

(56) References Cited

U.S. PATENT DOCUMENTS 4,989,770 A * 2/1991 Soto ..... B25B 27/00 225/103

* cited by examiner

*Primary Examiner* — Rick K Chang
(74) *Attorney, Agent, or Firm* — Timberline Patent Law Group

(57) ABSTRACT

Representative implementations of devices and techniques provide a tool that is used to prepare a squished C channel (Drive Cleat) segment for installation on HVAC duct work. In various embodiments, the tool includes a blade at one end of the tool that is configured to fit within the channel of the drive cleat, to open the channel a predetermined amount. Additionally, the tool can include a pocket portion on the other end of the tool that includes an opening for inserting a drive cleat portion into, for bending the drive cleat portion.

12 Claims, 9 Drawing Sheets

DRIVE CLEAT TOOL

PRIORITY CLAIM AND CROSS-REFERENCE TO RELATED APPLICATION

This application claims the benefit under 35 U.S.C. § 119(e)(1) of U.S. Provisional Application No. 62/487,585, filed Apr. 20, 2017, which is hereby incorporated by reference in its entirety.

BACKGROUND

Heated or cooled air is commonly moved within a building or structure via a series of interconnected ducts to provide climate control for the building or structure. For example, a heating, ventilation, and air conditioning (HVAC) duct assembly (including multiple ducts and duct work) can be used to move the heated or cooled air from a central source (for instance) to various remote locations throughout the building or structure. Additional channels can return fresh air from the remote locations to the central source to complete the circuit.

HVAC ducts are generally comprised of formed metal (e.g., galvanized steel, or the like) portions that are coupled together as desired. Specific bends at the ends of the portions (e.g., open rectangular box-shaped portions, or the like) of HVAC duct fit together to connect the portions of duct together and to form a continuous duct work for carrying air throughout the building or structure. The specific bends at the ends of the portions of duct form joints between each of the duct portions when they are fit together. A formed drive cleat, (having a squished C cross-section, for example) can fit over the joint between two duct portions, locking the joint.

Preparing a drive cleat for installation on the duct joint, using traditional techniques, generally includes using a screwdriver, or the like, to partially open one end of the C channel, so that the drive cleat can be slipped over the joint. However, the use of a tool such as a screwdriver to open the end of the drive cleat can pose a danger to the user. For instance if the user slips, the user could be injured by the screwdriver or by the sharp end of the drive cleat. Further, making consistent openings in the channel with the screwdriver can be difficult. Additionally, the opposite end of the drive cleat is often bent to conform to the box-like shape of the duct. Using a pair of tongs, or the like, the length of the bend is estimated by the user. Thus, the skill and experience of the user can be a key to uniform-length consistent bends. However, this can be a difficult learning process for a less-experienced user.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions shown in the illustrations of the figures are for example, and other shapes and or dimensions may be used and remain within the scope of the disclosure, unless specified otherwise.

DETAILED DESCRIPTION

Overview

Figure 1A:
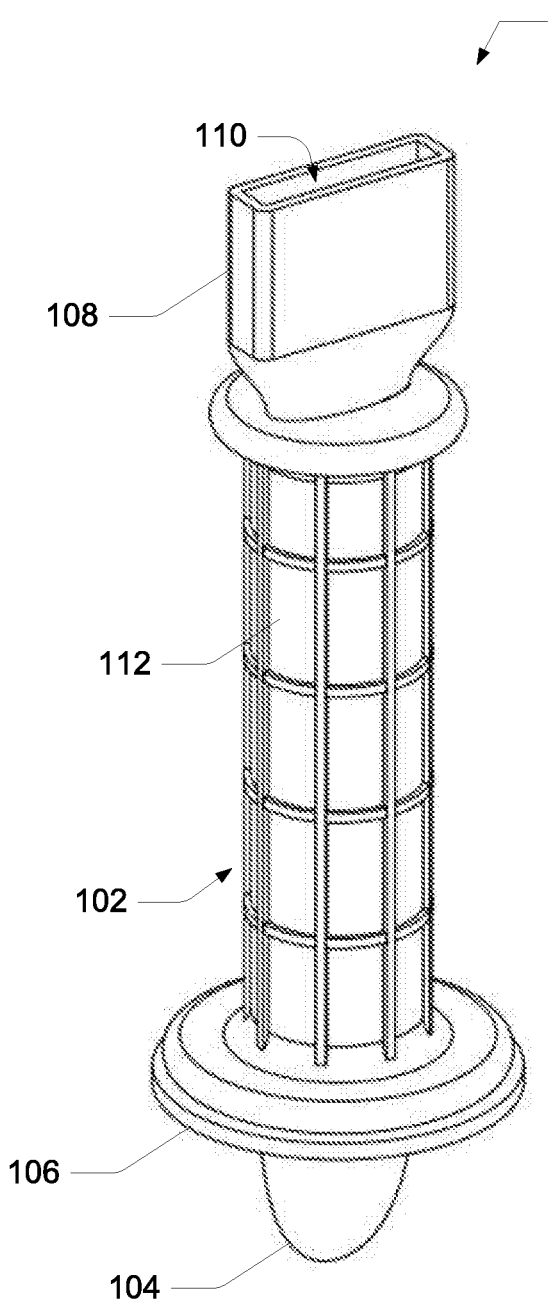
FIGS. 1A and 1B shows two views of an example drive cleat tool, according to an implementation.
Figure 1B:
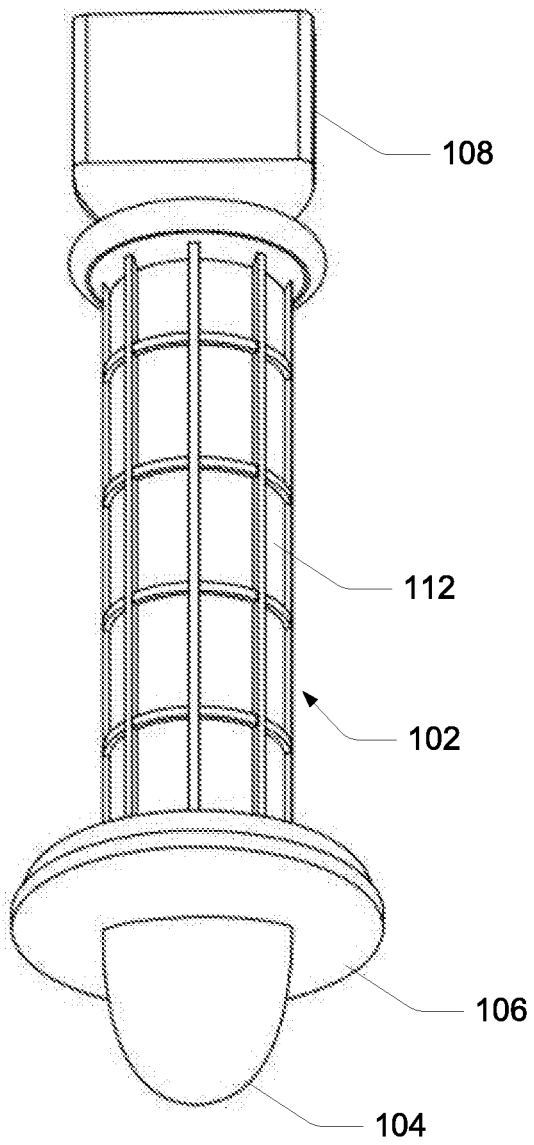

Referring to FIGS. 1A and 1B, in various embodiments, representative implementations of devices and techniques provide a drive cleat tool 100, comprising a hand-held tool that is used to prepare a squished C channel (Drive Cleat) segment for installation on HVAC duct work. In the embodiments, the drive cleat tool ("tool") 100 includes at least one functional aspect or portion on the end of a hand-held shaft 102. For instance, the tool 100 can include a blade 104 and a guard 106 at one end of the tool 100. Additionally, the tool 100 can include a pocket portion 108 on the other end of the tool 100. For example, the pocket portion 108 can include an opening 110 for inserting a drive cleat portion into. Each of these functional portions of the tool 100 are discussed further below.

Figure 2:
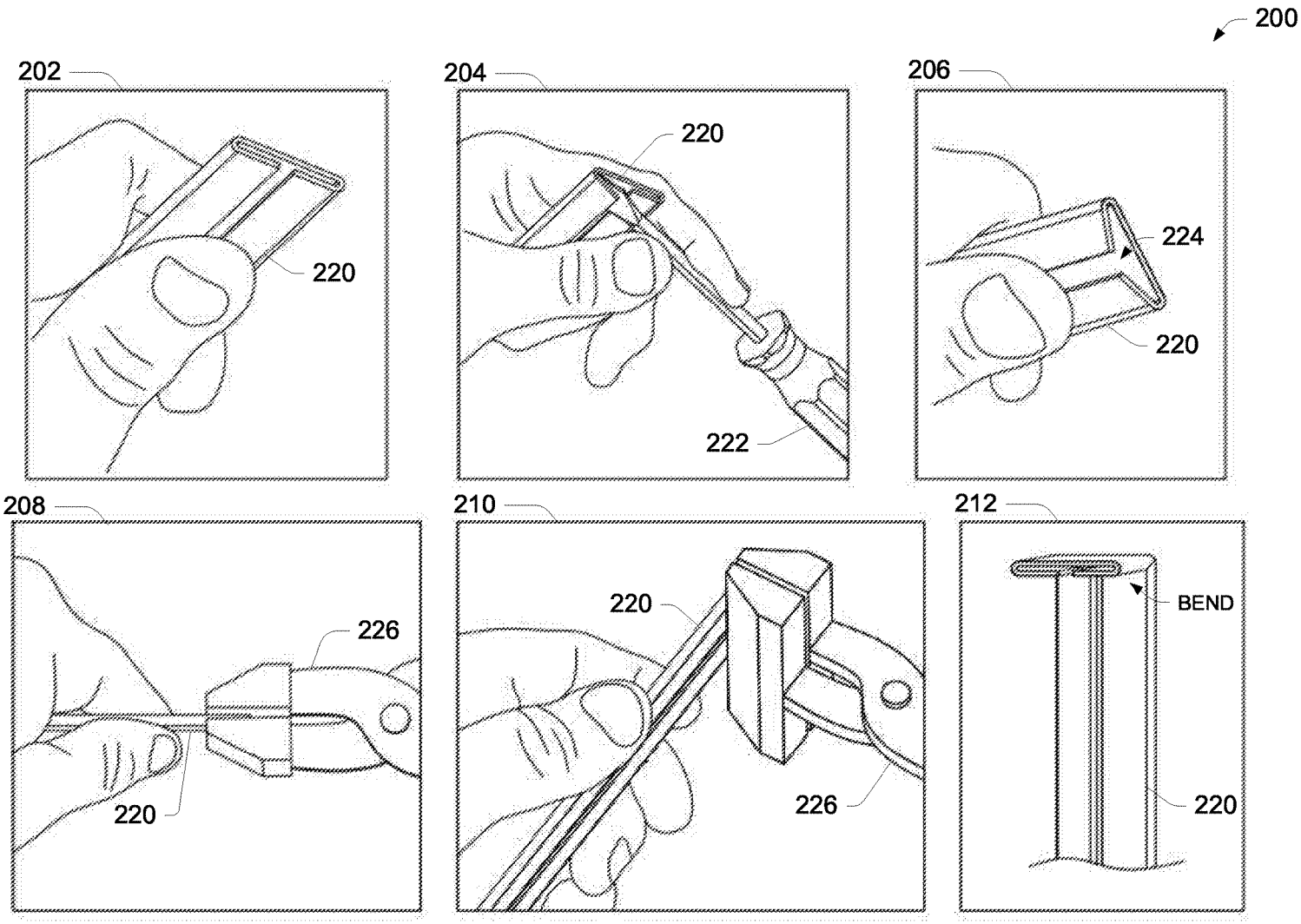
FIG. 2 shows an example sequence of preparing a drive cleat for installation, using traditional techniques.

FIG. 2 shows an example sequence 200 of preparing a drive cleat 220 for installation, using traditional techniques. Generally, the drive cleat 220 is given standard adjustments to fit the locking seam 320 of an "S and Drive" heating, ventilation, and air conditioning (HVAC) duct work assembly (see FIG. 3). Commonly, the drive cleat 220 and the HVAC duct assembly are comprised of formed metal (e.g., galvanized steel, or the like). Specific bends at the ends of portions (e.g., open rectangular box-shaped portions, or the like) of HVAC duct fit together to connect the portions of duct together and to form a continuous duct work for carrying air throughout a building or structure.

The specific bends at the ends of the portions of duct form joints 320 between each of the duct portions when they are fit together. A formed drive cleat 220, (having a squished C cross-section, for example) fits over the joint 320 between two duct portions, locking the joint 320. Typically, the drive cleat 220 (i.e., a segment of drive cleat 220) is inserted over an end of the joint 320, and slid over the joint to lock it (see FIG. 3). The standard adjustments to the drive cleat 220 allow the user to insert the drive cleat 220 over the end of the joint 320, and to slide it onto the joint 320 to the desired length, forming a secure joint 320 in the HVAC duct.

Referring to FIG. 2, at 202, the drive cleat 220 is cut to length. At 204, one end of the drive cleat 220 is opened or widened, using a screwdriver 222, for instance, or like tool. The seam 224 of the drive cleat 220 should be wide enough to slip onto the joint 320 of the duct work, but should not be opened so much that the seam 224 is loose and will not hold. Accordingly, the skill and experience of the user can be a key to a properly sized opening, since the screwdriver 222 may offer little or no assistance in sizing the seam 224.

As shown at 204 and 206, the use of a tool 222 such as a screwdriver to open the end of the drive cleat 220 can pose a danger to the user. For instance if the user slips, the user could be injured by the screwdriver 222 or by the sharp end of the drive cleat 220.

Beginning at 208, the opposite end of the drive cleat 220 is prepared by squaring and bending the drive cleat 220 using a pair of tongs 226, for instance. At 210, the end of the drive cleat 220 is generally bent to a 90° angle (shown at 212), to conform to the rectangular box-shape of the duct. Forming a proper square end on the drive cleat 220 requires that the drive cleat 220 be inserted squarely into the jaws of the tongs 226. The length of the bend is estimated by the user. Thus, the skill and experience of the user can be a key to uniform-length and consistent square bends, since the tongs 226 may offer little or no assistance in forming the bend. A drive cleat 220 with a prepared bend is shown at 212.

Figure 3:
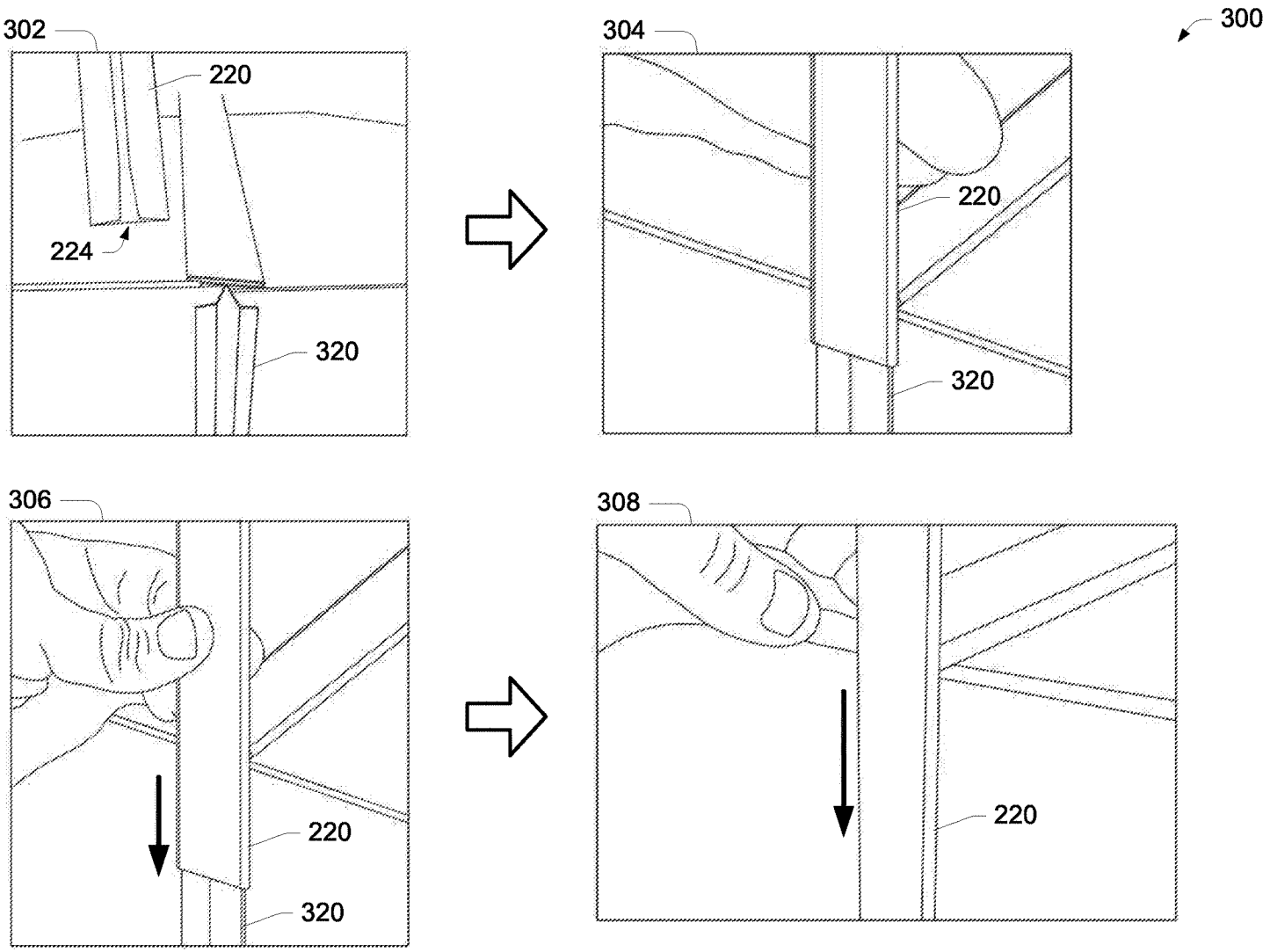
FIG. 3 shows an example sequence of installing a prepared drive cleat on a HVAC duct.

FIG. 3 shows an example sequence 300 of installing a prepared drive cleat 220 on a joint 320 of a HVAC duct. Referring to FIG. 3, as described above, at 302 the prepared drive cleat 220 is inserted (shown at 304) onto the joint 320 between portions of HVAC duct. At 306, the drive cleat 220 is slid (continued at 308) over the joint 320, until the bend in the drive cleat 220 meets the top of the joint 320 (not shown). The bend in the drive cleat 220 contacts the top of the duct to hold the drive cleat 220 in position. The first end of the drive cleat 220 may also be bent once the drive cleat 220 is in place, to secure the drive cleat 220 in place on the joint 320. Alternately, the drive cleat 220 may be fastened to the duct or the joint 320 using fasteners (such as screws, etc.) if desired.

Techniques and devices are discussed with reference to example HVAC ducts illustrated in the figures. However, this is not intended to be limiting, and is for ease of discussion and illustrative convenience. The tool 100 described herein and the techniques and devices disclosed herein may be applied to various other uses, including other ducts, channels, containers, implements, tools, objects, and the like, and remain within the scope of the disclosure. For the purposes of this disclosure, the generic term "duct" is used herein.

Further, the shape and configuration of the tool 100 and its components (including the blade, guard, pocket, pocket opening, etc.) may vary from that illustrated in the figures to accommodate the various objects to be formed with the tool 100, as well as to accommodate various applications. In alternate embodiments, fewer, additional, or alternate components may be used and/or combined to form a tool 100 having an equivalent function and operation.

Implementations are explained in more detail below using a plurality of examples. Although various implementations and examples are discussed here and below, further implementations and examples may be possible by combining the features and elements of individual implementations and examples.

Example Embodiments

Referring to FIGS. 4A-4D, as well as referring back to FIGS. 1A and 1B, disclosed herein is a drive cleat tool 100 and preparation techniques which may be used to prepare a drive cleat 220 for installation on a HVAC duct with the tool 100. The drive cleat tool 100 is arranged to be used by a user to prepare both ends of the drive cleat 220 segment. For example, one end of the drive cleat tool 100 (the "blade 104") is used to provide an opened or widened end on the segment of drive cleat 220, so that the drive cleat 220 can be inserted and slid onto the locking seam 320 of a HVAC duct work assembly. The other end of the drive cleat tool 100 (the "pocket 108") is used to provide a bended end on the other end of the segment of drive cleat 220, as a termination. In various implementations, the two ends of the drive cleat tool 100 described herein (e.g., the blade 104 and the pocket 108) are part of a single hand-held tool 100. In alternate implementations, the two ends (e.g., the blade 104 and the pocket 108) are part of at least two separate tools 100.

As shown in FIGS. 1A and 1B and FIGS. 4A-4C, a drive cleat tool 100 can include a shaft 102 with the blade 104 coupled to one end of the shaft 102. Also, the pocket 108 may be coupled to the other end of the shaft 102. In various embodiments, the shaft 102 may be substantially straight, as shown in FIGS. 1A and 1B, or the shaft 102 may have a curve, bend, or angle to accommodate a particular use or application. The shaft 102 may have an elliptical cross-section, or any of various polygonal cross-sections. The shaft 102 may be at least partly covered with a handle grip 112, for improved grip and comfort.

In some embodiments, the drive cleat tool 100 includes a guard 106, which may be disposed on the blade 104 end of the tool 100, to protect the user's hand during use. The guard 106 (which may have any regular or irregular shape) extends in one or more directions away from the shaft 102. The guard 106 may extend normal to the shaft 102 (as shown in the illustrations), or the guard 106 may extend at one or more angles from the shaft 102.

In an example embodiment, the rigid blade 104 extends from the shaft 102 parallel to a primary axis of the shaft 102. The blade 104 may be approximately 1 inch wide at its widest point (near the shaft 102) to fit within the channel of a standard 1 inch drive cleat 220. The pocket opening 110 may be slightly larger than one inch wide (e.g., 1-5 mm wider, and preferably 1-2 mm wider) to receive a standard 1-inch drive cleat 220 within. In various other embodiments, the drive cleat tool 100 may have other dimensions as desired, or to accommodate other possible drive cleat 220 sizes, for example (e.g., such as other standard sizing, international sizing, etc.).

Figure 4A:
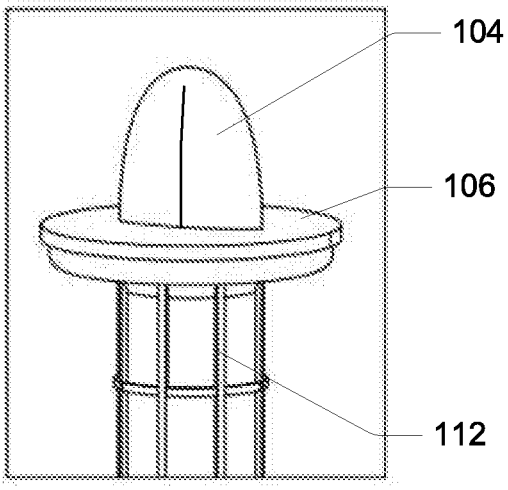
FIG. 4A shows a blade end of the example drive cleat tool of FIGS. 1A and 1B.
Figure 4B:
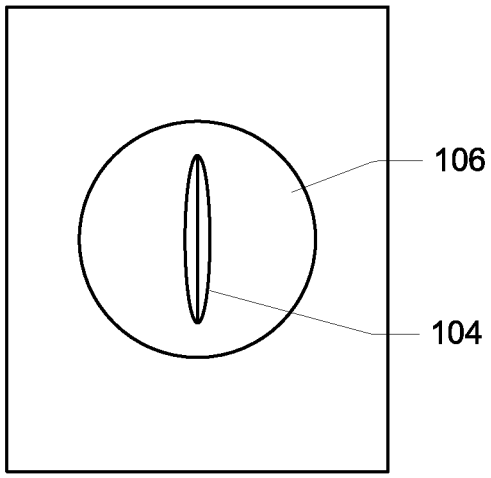
FIG. 4B shows a top view of the blade end of the example drive cleat tool of FIGS. 1A and 1B.

In an embodiment, as shown in FIGS. 4A and 4B, the blade 104 may have a symmetrical tapered shape that is thinner at the edges and thicker towards the center of the blade 104. The tapered shape gives the blade 104 a wedge form, so as to be inserted into the channel of the drive cleat 220. Further, the blade 104 may have a semi-rounded/elliptical profile as shown, or it may have a polygonal or irregular profile as desired. The combination of the tapered shape and the profile of the blade makes it useful for easily inserting into the C-channel of the drive cleat 220, and widening the end of the channel seam 224 as desired.

Figure 4C:
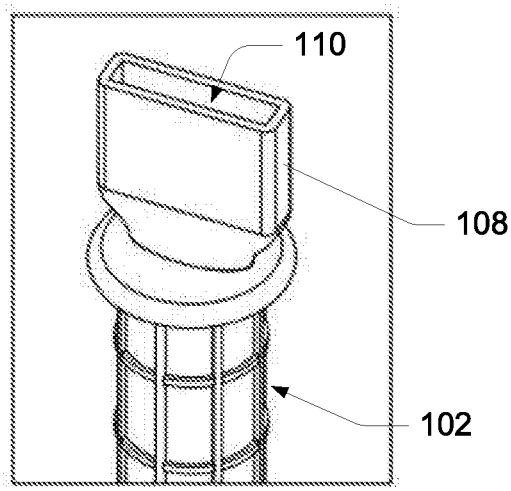
FIG. 4C shows a pocket end of the example drive cleat tool of FIGS. 1A and 1B.
Figure 9:
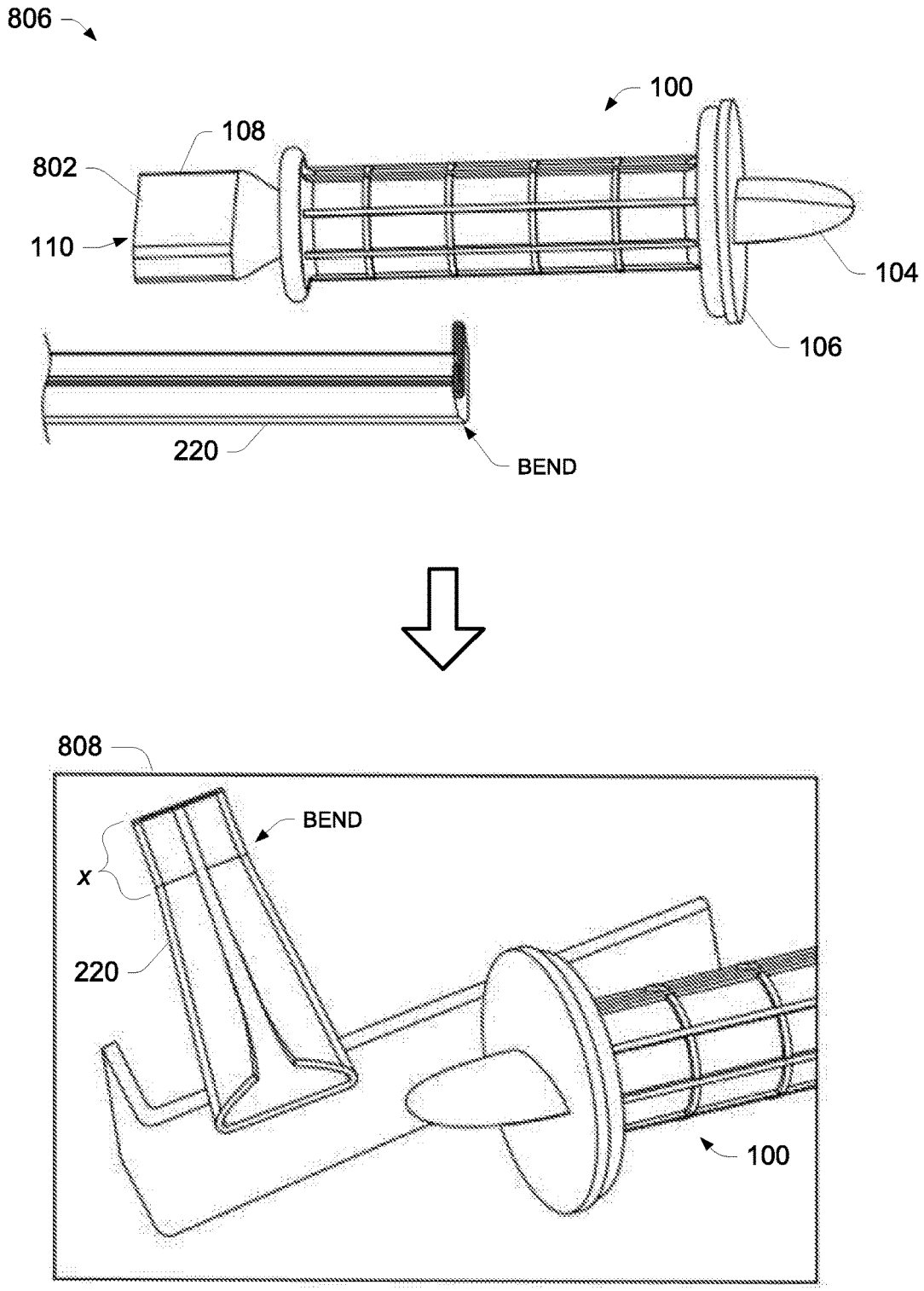
FIG. 9 shows a continuation of the example sequence of preparing the other end of the drive cleat using the example drive cleat tool, according to the embodiment.

In an embodiment, as shown in FIG. 4C, the rigid pocket 108 is coupled at a second end of the shaft 102 and comprises an oblong tube. The pocket 108 includes a pocket opening 110 for inserting an opposite end of the drive cleat 220 into. The pocket 108 may be shaped and sized to closely fit over an inserted drive cleat 220. For example, the pocket opening 110 may be marginally wider (e.g., 1 to 2 mm, or the like) than the width of the drive cleat 220, thus allowing the drive cleat 220 to be easily inserted into the opening 110, but with a snug fit that prevents undesirable movement of the drive cleat 220 while it is within the pocket 108. Further, the depth of the interior of the pocket 108 may be sized for a desired drive cleat bend length (e.g., 1 inch, or the like). For example, an interior of the pocket 108 includes at least one stop at a base of the oblong tube, configured to square the drive cleat 220 relative to the tube, when inserted into the oblong tube. The pocket 108 is configured to hold the drive cleat 220 while the bend is placed in the second end of the drive cleat 220, and to determine the placement of the bend, i.e., the distance ("x" as shown in FIG. 9) of the bend from the second end of the drive cleat 220.

Figure 4D:
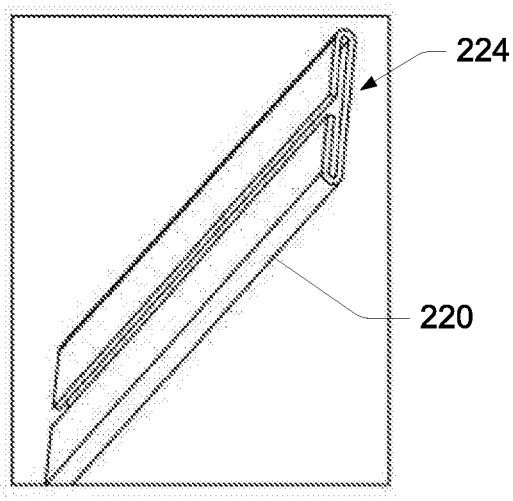
FIG. 4D shows an example drive cleat.

The handle grip 112 of the drive cleat tool 100 helps the user to maintain a positive grip on the tool 100 while working. The guard 106 of the drive cleat tool 100 protects the user from accidental injury, particularly the hand of the user that is holding the tool 100. FIG. 4D shows a typical drive cleat 220 portion.

Figure 5:
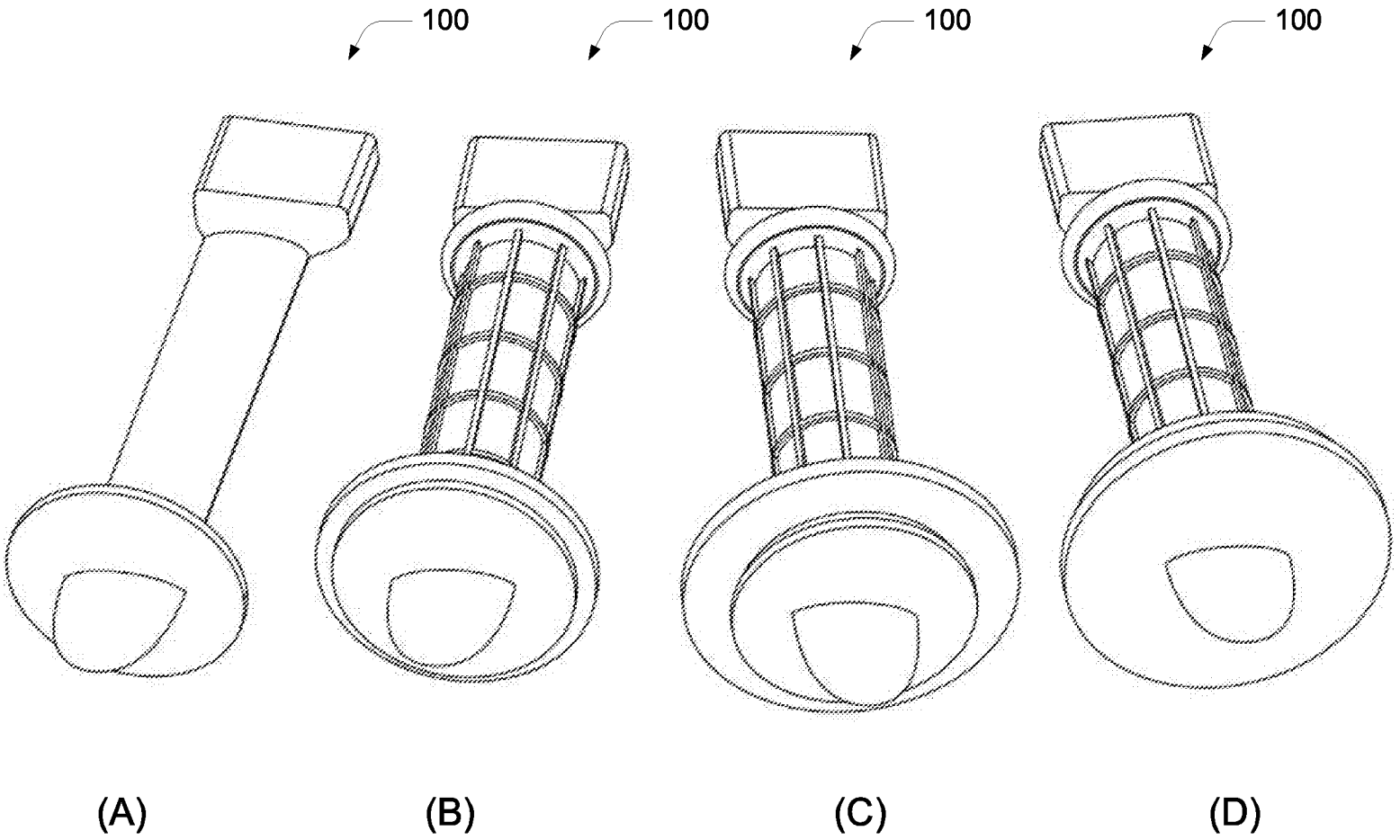
FIG. 5 shows four example variations (at A-D) of an example drive cleat tool.

As shown in FIG. 5, four variations (at A-D) of the drive cleat tool 100 are shown; however, many variations are contemplated. A drive cleat tool 100 without a handle grip 112 is shown at (A), and drive cleat tools 100 with different sizes of guards 106 are shown at (B-D). In various embodiments, a drive cleat tool 100 may have additional, fewer, or alternate features.

Figure 6:
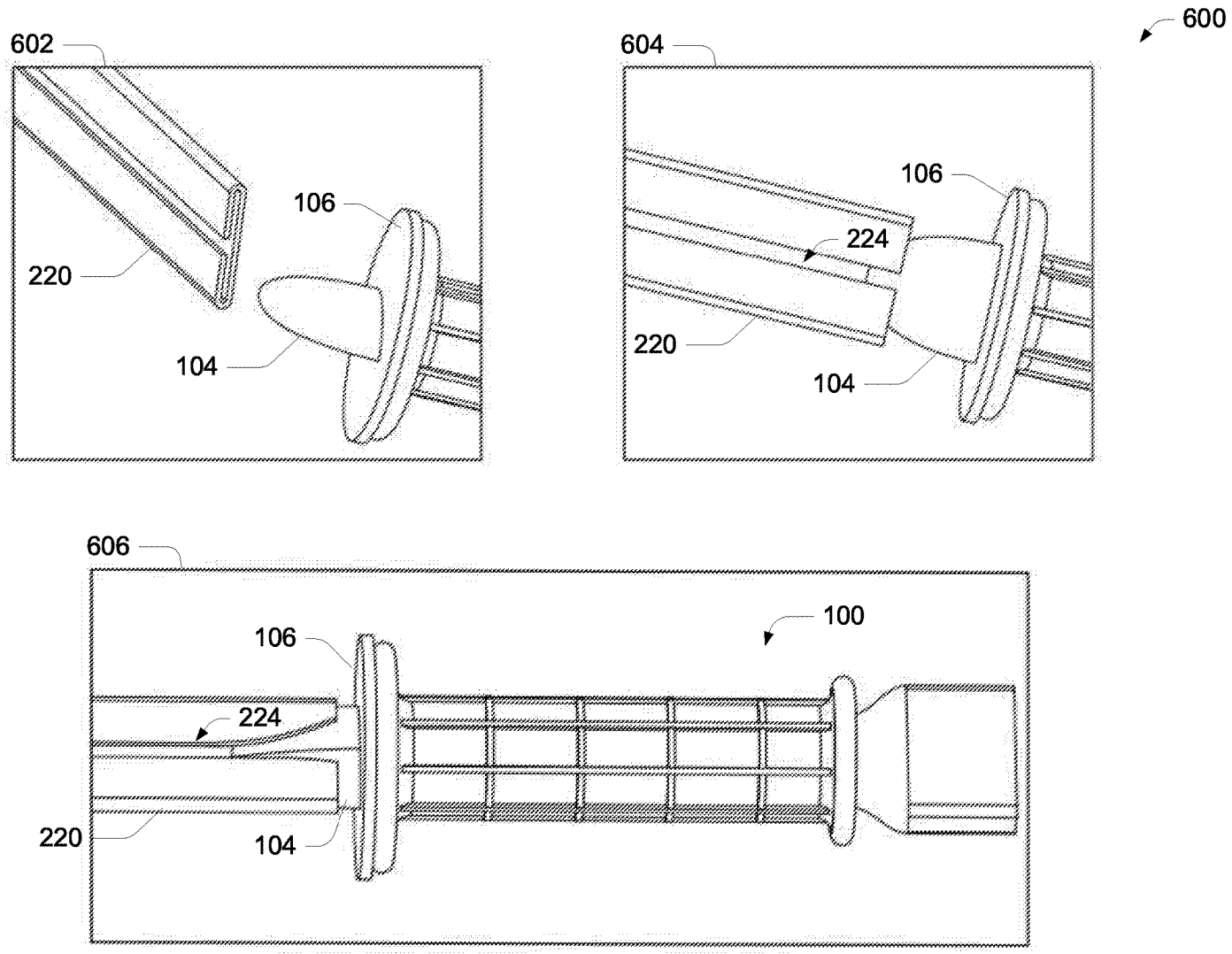
FIG. 6 shows an example sequence of preparing one end of a drive cleat using an example drive cleat tool, according to an embodiment.
Figure 7:
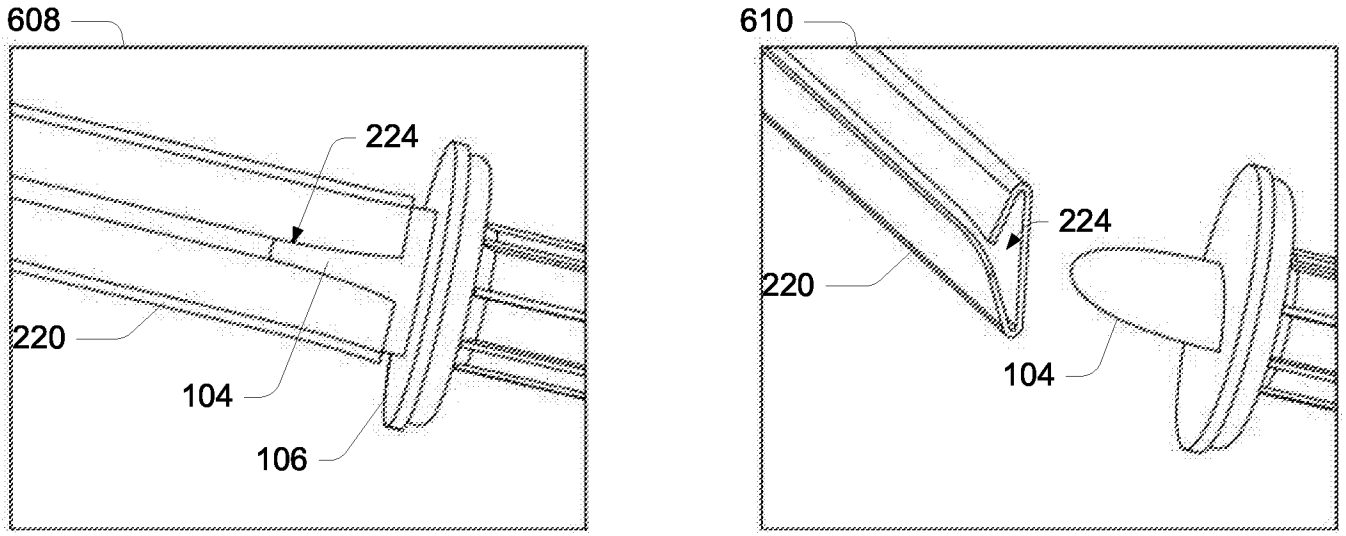
FIG. 7 shows a continuation of the example sequence of preparing the end of the drive cleat using the example drive cleat tool, according to the embodiment.

FIGS. 6 and 7 show a process 600 for preparing a first end of the drive cleat 220 using an example drive cleat tool 100, according to an embodiment. At 602 the drive cleat 220 is cut to length, and at 604, the blade 104 of the drive cleat tool 100 is inserted into the first end of the drive cleat 220 segment. The guard 106 protects the hand of the user from injury should the drive cleat 220 slip during any part of this process. At 606, the tapered shape of the blade 104 causes the seam 224 of the drive cleat 220 to open or widen (i.e., separates the seam 224) as the tool 100 is inserted into the channel of the drive cleat 220.

At 608 (shown at FIG. 7), the blade 104 is fully inserted into the drive cleat 220, up to the blade guard 106 of the tool. The tapered shape of the blade 104, as well as the length of the blade 104 from the tip of the blade 104 to the base of the blade 104 at the guard 106, determines the amount of opening or widening of the seam 224 of the drive cleat 220, rather than the skill or experience of the user. At 610, the blade 104 is removed from the drive cleat 220, leaving a finished open end of the drive cleat 220 as shown. The shape and size of the blade 104 ensures that the opening in the seam 224 at the first end of the drive cleat 220 will have the desired width and depth consistently (not too tight and not too loose for the joint 302) with each use, regardless of the experience of the user.

Figure 8:
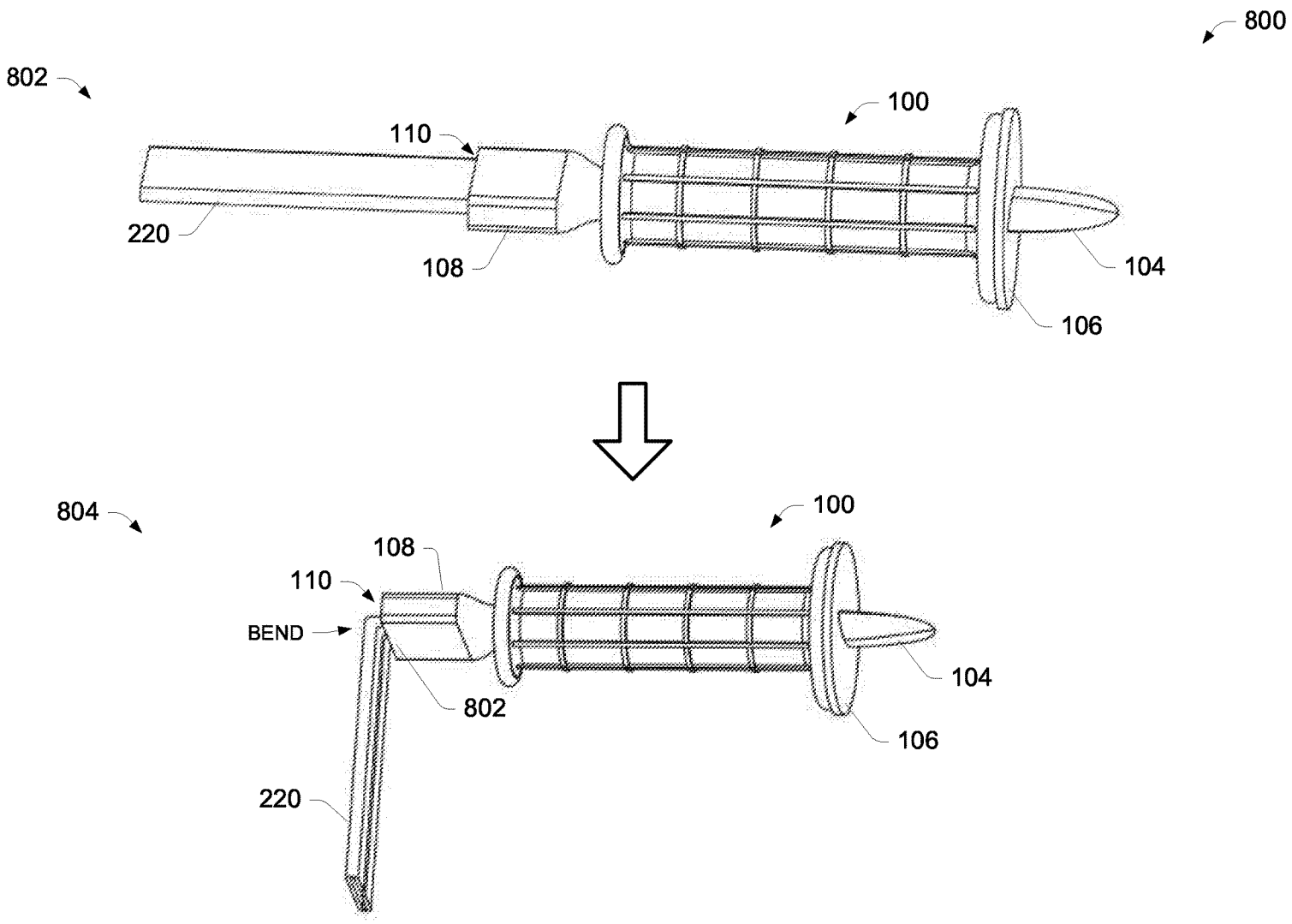
FIG. 8 shows an example sequence of preparing another end of a drive cleat using an example drive cleat tool, according to an embodiment.

FIGS. 8 and 9 shows a process 800 for preparing the second end of the drive cleat 220 using an example drive cleat tool 100, according to an embodiment. At 802, the second end (e.g., the opposite end of the end adjusted in process 600) of the drive cleat 220 is inserted into the opening 110 of the pocket 108 of the drive cleat tool 100. In an embodiment, the interior of the pocket 108 and the opening 110 of the pocket 108 are designed so that the drive cleat 220 will automatically be squared within the pocket 108 at the desired depth (one inch in depth, for example) when the drive cleat 220 is fully inserted into the pocket 108 (e.g., when the drive cleat 220 is contacting the bottom of the interior of the pocket 108). For example, the bottom of the interior of the pocket 108 may be formed to be square with the sides of the interior of the pocket 108. In an embodiment, the interior of the oblong tube of the rigid pocket 108 includes at least one stop at a base of the tube, configured to square the drive cleat 220 relative to the tube, while the drive cleat 220 is inserted into the pocket 108. In various implementations, the stop comprises the base of the interior of the pocket 108.

At 804, the user bends the drive cleat 220 over while the drive cleat 220 is inserted into the pocket 108. The drive cleat 220 is bent over at the opening 110 of the pocket 108, using the wall 802 of the pocket 108, to determine the bend position on the drive cleat 220. In an embodiment, the width of the opening 110 within the pocket 108 is slightly larger (e.g., 1 to 2 mm) than the width of the drive cleat 220 (the width can be different for different drive cleats 220, for instance), maintaining a snug fit of the drive cleat 220 in the pocket 108. This prevents the drive cleat 220 from moving side to side within the pocket 108, to assist in making a true square bend. Also, the depth of the pocket 108 acts as a gauge to determine the desired bend position on the drive cleat 220. The shape and size of the pocket 108 increases accuracy and consistency, by allowing the user to make a square bend at the desired length (i.e., the distance "x" as shown in FIG. 9) from the second end of the drive cleat 220 without undue effort. In some embodiments, the thickness of one or more of the walls 802 of the pocket 108 assists in making a 90° bend. For example, as the user bends the drive cleat 220 using the edge of the pocket wall 802, the thickness of the pocket wall 802 can provide a stop for the bend, at the desired angle (at 90-degrees, for example). The user can stop bending when the drive cleat 220 contacts the wall 802 of the pocket 108.

At 806 (shown at FIG. 9), the drive cleat 220 is removed from the pocket 108 of the tool 100. As shown at 808, bending the drive cleat 220 completes the second end of the drive cleat 220. The drive cleat 220 is now ready to be installed on a duct joint 302, as described with reference to FIG. 3.

In various implementations, components of the drive cleat tool 100 are comprised of various metals, composites, combinations of the same, or the like. For example, the shaft 102, guard 106, and pocket 108 may be comprised of a metal such as aluminum, iron, brass, steel, or the like, or a fiber composite, or the like. These components may be cast or molded if desired for durability while keeping a low cost. The blade 104 may be comprised of a metal such as aluminum, iron, brass, steel, or the like. The blade 104 may also be cast, but may also be forged for greater strength if desired. The blade 104, guard, 106, shaft 102, and/or pocket 108 may be formed as a single piece, or may be formed in two or more components and assembled into a tool 100. The handle grip 112 may be comprised of a natural or synthetic leather, a heavy duty textile, a plastic, or the like.

In various implementations, the drive cleat tool 100 may include fewer, more, or alternate components, and remain within the scope of the disclosure. In various embodiments, the shape and configuration of the drive cleat tool 100 components may vary to accommodate different implements or applications.

The illustrations of FIGS. 1A-9 are not intended to be limiting. In the various example embodiments illustrated in FIGS. 1A-9, the location, dimensions, and position of the components, and the like are for example only. Other locations, dimensions, and positions are contemplated and are within the scope of this disclosure. In some cases, additional or alternative components, techniques, sequences, or processes may be used to implement the techniques described herein. Further, the components and/or techniques may be arranged and/or combined in various combinations, while resulting in similar or approximately identical results. It is to be understood that a drive cleat tool 100 may be implemented as a stand-alone device or as part of another system (e.g., integrated with other components). In various implementations, additional or alternative components may be used to accomplish the disclosed techniques and arrangements.

Although some implementations and examples are discussed herein, further implementations and examples may be possible by combining the features and elements of individual implementations and examples.

CONCLUSION

Although the implementations of the disclosure have been described in language specific to structural features and/or methodological acts, it is to be understood that the implementations are not necessarily limited to the specific features or acts described. Rather, the specific features and acts are disclosed as representative forms of implementing the disclosed devices and techniques.

What is claimed is:

1. A tool system, comprising:

a shaft;

a straight, rigid, tapered blade coupled at a first end of the shaft, the blade having a tapering overall profile and extending straight out from the first end of the shaft parallel to a primary axis of the shaft;

a guard disposed at the first end of the shaft at a base of the blade, the guard comprising a circular plate attached to the first end of the shaft, centered at the longitudinal axis of the shaft, wherein the tapering profile of the blade originates at the circular plate and at the longitudinal axis of the shaft; and a rigid pocket coupled at a second end of the shaft, the pocket comprising an oblong tube, an interior of the tube including a stop at a base of the tube configured to square an object inserted into the tube relative to the tube.

2. The tool system of claim 1, further comprising a handle grip surrounding at least part of the shaft, the handle grip arranged to be grasped by a user.

3. The tool system of claim 1, wherein the blade has a symmetrical shape that is thinner at both edges of the blade and thicker at an interior point of the blade.

4. The tool system of claim 1, wherein the blade is configured to closely fit within a channel of a drive cleat of a heating, ventilation, and air conditioning (HVAC) duct assembly, the blade having a width of approximately one inch at a widest point of the blade where the blade contacts the shaft, and the interior of the tube having a width less than 5 millimeters greater than the width of the blade at the widest point of the blade.

5. The tool system of claim 1, wherein the opening of the pocket has an oblong shape configured to closely fit over an end of a drive cleat of a heating, ventilation, and air conditioning (HVAC) duct assembly, a width of the oblong tube being approximately one inch, and wherein a depth of the pocket is approximately equal to the width of the oblong tube, and configured to allow the drive cleat to be inserted into the pocket a predetermined length from the end of the drive cleat.

6. The tool system of claim 5, wherein the pocket is configured to hold the drive cleat while a bend is placed in the drive cleat, a wall of the pocket having a thickness configured to provide a stop for the bend, to determine a bend angle for the bend.

7. The tool system of claim 1, wherein one or more of the shaft, blade, and pocket are comprised of steel.

8. A tool system, comprising:

a shaft arranged to be gripped by a user;

a straight blade at one end of the shaft, the blade having a tapered shape that is thinner at one or more edges of the blade and thicker at an interior point of the blade, a width of the blade having a semi-elliptical profile, the blade extending straight out from the one end of the shaft parallel to a primary axis of the shaft and arranged to closely fit into a channel of a drive cleat of a heating, ventilation, and air conditioning (HVAC) duct assembly from a first end of the drive cleat;

a guard disposed at the one end of the shaft at a base of the blade, the guard comprising a circular plate attached to the one end of the shaft, centered at the longitudinal axis of the shaft, wherein the tapered shape of the blade originates at the circular plate and at the longitudinal axis of the shaft; and a pocket at an opposite end of the shaft, the pocket having a pocket opening, a width and depth of the pocket opening being equal and configured to closely fit over a second end of the drive cleat.

9. The tool system of claim 8, further comprising a handle grip surrounding at least a part of the shaft, the handle grip comprising a durable material arranged to be grasped by the user.

10. The tool system of claim 8, wherein the blade extends a first direction from the shaft and wherein the pocket is disposed on the shaft such that the pocket opening extends an opposite direction from the first direction.

11. The tool system of claim 8, wherein the blade is configured to open a seam of the drive cleat at the first end of the drive cleat a predetermined width when the blade is inserted into the channel, based on a predetermined length and a taper of the blade.

12. The tool system of claim 8, wherein the pocket is configured to hold the drive cleat while the user bends the drive cleat over a wall of the pocket at a predetermined length from the second end of the drive cleat based on a length of the pocket, while the second end of the drive cleat is fully inserted into the pocket.

* * * * *